US007158025B2

(12) United States Patent
Matoba

(10) Patent No.: US 7,158,025 B2
(45) Date of Patent: Jan. 2, 2007

(54) EMERGENCY ALARM SYSTEM

(76) Inventor: Miyoji Matoba, 2-31-6, Tsukada-machi, Wajima-shi, Ishikawa (JP)

( * ) Notice: Subject to any disclaimer, the term of this patent is extended or adjusted under 35 U.S.C. 154(b) by 133 days.

(21) Appl. No.: 11/086,610

(22) Filed: Mar. 22, 2005

(65) Prior Publication Data

US 2005/0248451 A1 Nov. 10, 2005

(30) Foreign Application Priority Data

Mar. 22, 2004 (JP) ..... P2004-082997

(51) Int. Cl.
*G08B 23/00* (2006.01)

(52) U.S. Cl. ..... 340/517; 340/539.1; 340/540; 340/573.1; 379/37; 379/38; 379/45

(58) Field of Classification Search ..... 340/517, 340/539.1, 540, 573.1, 539.11, 574; 379/37, 379/38, 45
See application file for complete search history.

(56) References Cited

U.S. PATENT DOCUMENTS 7,091,852 B1 * 8/2006 Mason et al. ..... 340/539.13

2005/0174230 A1 * 8/2005 Matoba ..... 340/517

* cited by examiner

*Primary Examiner*—Jeffery Hofsass
*Assistant Examiner*—Samuel J. Walk
(74) *Attorney, Agent, or Firm*—Kilpatrick Stockton LLP

(57) ABSTRACT

An emergency alarm system is disclosed as including a base unit 9, adapted to be installed in an architectural structure at an area attracting public attention, which incorporates a temperature sensor 29, a gas sensor 31, a sound sensor 33 and a vibration sensor 35 and includes a transmitter 39, a receiver 41, a sound generator 37 and a display board 27; a mobile handset 23, carried by a person for self-defense, which incorporates a temperature sensor 51 and a gas sensor 53 and includes a transmitter 59, a receiver 61, a sound generator 55 and a light source 57; and infrared ray sensors 13, installed in respective rooms in the architectural structure, which incorporates a temperature sensor 69 and a gas sensor 71 and includes a transmitter 73; wherein when one of the sensors of the base unit 9, the mobile handset 23 and the infrared ray sensors 13 detects an abnormal signal under an emergency condition, the base unit 9, the mobile handset 23 and the infrared ray sensors 13 mutually communicate with each other through the associated transmitters and receivers.

7 Claims, 4 Drawing Sheets

EMERGENCY ALARM SYSTEM

BACKGROUND OF THE INVENTION

1. Technical Field

The present invention relates to emergency alarm systems and, more particularly, to an emergency alarm system effective for backing up lifesaving in an architectural structure under emergency conditions.

2. Related Art

Japanese Patent Provisional Publication No. 2003-308585 discloses a disaster alarm device that includes a case, mountable on an architectural structure or equipment thereof, which accommodates therein a disaster sensing unit of at least one kind operative to output a detection signal when sensing a disaster of a predetermined kind, and an alarm unit started up in response to the detection signal outputted from the disaster sensing unit and operative to inform a location of installed properties for emergency, which is preliminarily prepared against disasters, in the form of an optical signal or a voice message.

SUMMARY OF THE INVENTION

The disaster alarm device, mentioned above, was configured in a structure in which information is distributed from the disaster alarm device to persons on one-sided basis to inform people with information about a location of emergency properties under the emergency conditions. However, during the occurrence of actual disasters, there is a need for information to be fed back from the person in the vicinity of the location where a disaster occurs and, in that sense, the disaster alarm device, mentioned above, encounters issues in which no consideration is made on an aspect of distributing information in a bi-directional fashion between the device and the person.

The present invention has been completed with the above issues in mind and has one aspect to provide an emergency alarm system comprising a base unit, adapted to be installed in an architectural structure at an area attracting public attention, which includes a temperature sensor, a gas sensor, a sound sensor, a vibration sensor, a transmitter, a receiver, a sound generator and a display board, a mobile handset carried by a person for self-defense and having a temperature sensor, a gas sensor, a transmitter, a receiver, a sound generator and a light source, and infrared ray sensors installed in respective rooms in the architectural structure and each having a temperature sensor, a gas sensor, a transmitter and a receiver, wherein when one of the sensors of the base unit, the mobile handset and the infrared ray sensors detects an abnormal signal under an emergency condition, the base unit, the mobile handset and the infrared ray sensors mutually communicate with each other through the transmitters and the receivers of the base unit, the mobile handset and the infrared ray sensors, respectively.

DETAILED DESCRIPTION OF THE PREFERRED EMBODIMENS

Hereinafter, an embodiment according to the present invention is described in detail with reference to the accompanying drawings.

Figure 1:
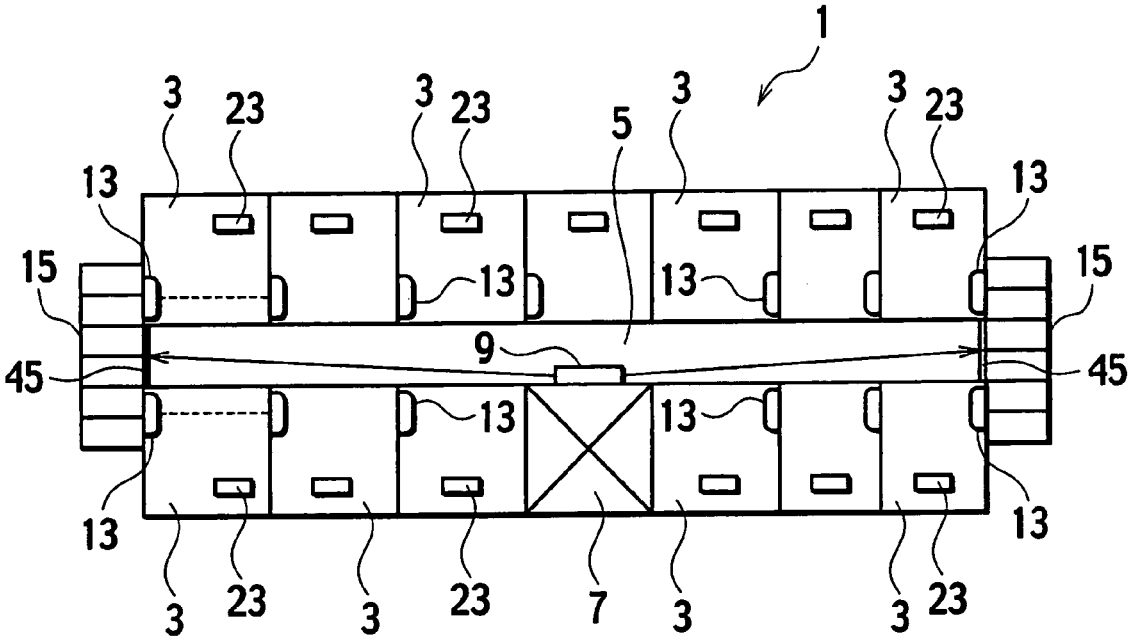
FIG. 1 is a plan view of a hotel employing an emergency alarm system of an embodiment according to the present invention.

FIG. 1 is a schematic view illustrating an emergency alarm system of the presently filed embodiment as applied to various floors of a hotel.

Figure 2:
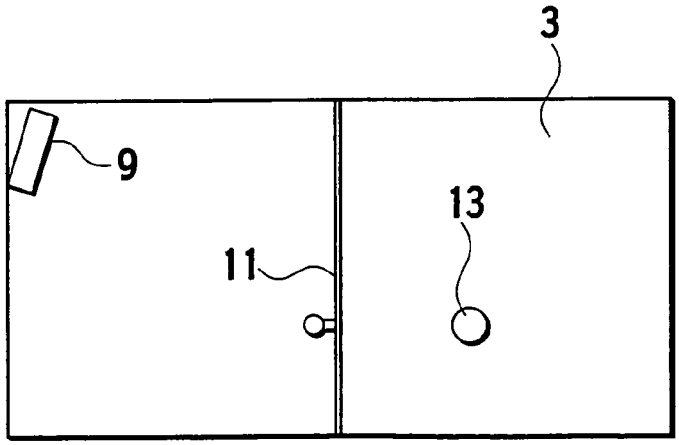
FIG. 2 is a side view of an elevator section shown in FIG. 1.
Figure 3:
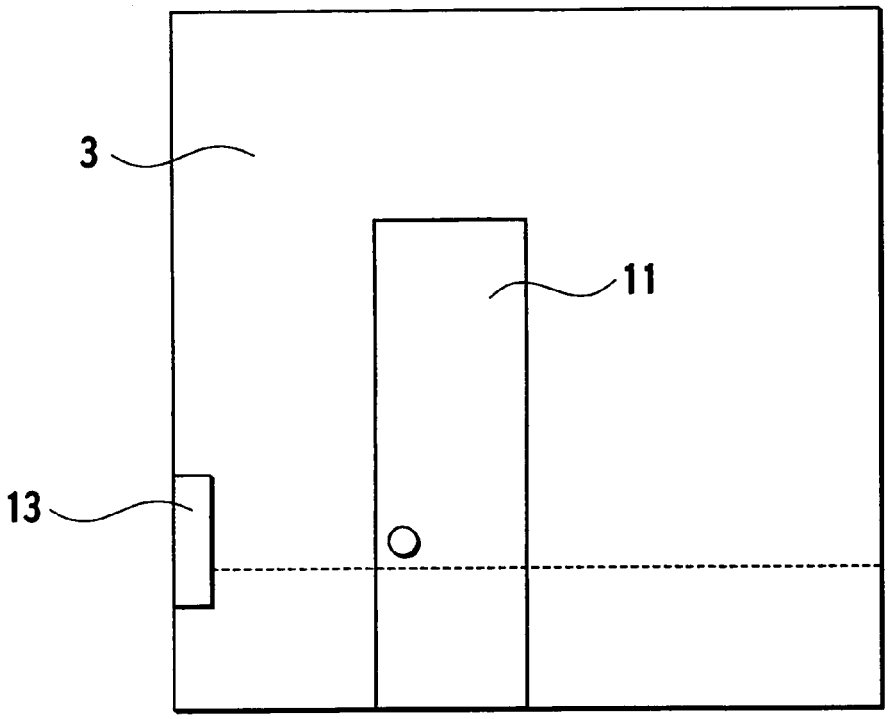
FIG. 3 is a front view of a room shown in FIG. 1.
Figure 4:
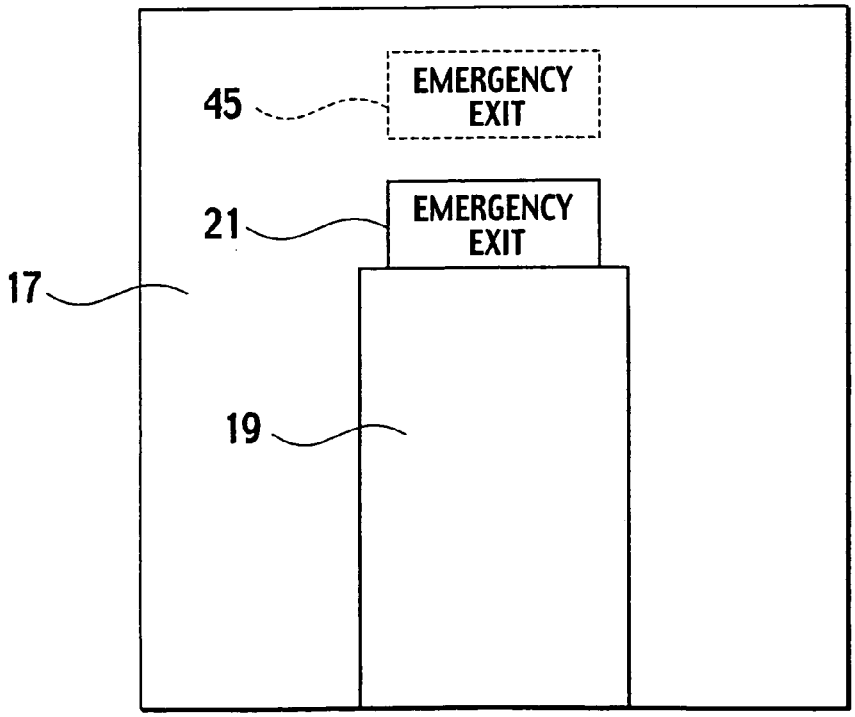
FIG. 4 is a side view of an emergency doorway area shown in FIG. 1.

A plurality of rooms 3 is disposed in various floors of the hotel 1 and an elevator 7 is located in a central area. As shown in FIG. 2, a base unit 9 is mounted on a wall at an area, for instance, an upper corner in front the elevator 7. The base unit 9 may be located in any place provided that the base unit 9 is in the public eye within a building. As shown in FIGS. 2 and 3, infrared ray sensors 13 are mounted on inner sidewalls of rooms 3 in the vicinity of respective entrance doors 11. As shown in FIG. 4, further, emergency staircases 15 are located on both sides of a corridor 5. Emergency doorways 19 are provided on inside walls 17 of the emergency stairways 15, respectively. Emergency exit plates 21 are mounted on the inside walls 17 at upper areas thereof, respectively, on which the respective emergency doorways 19 are located. Inhabitants in respective rooms 3 take along mobile handsets 23, respectively for emergency rescues.

Figure 5:
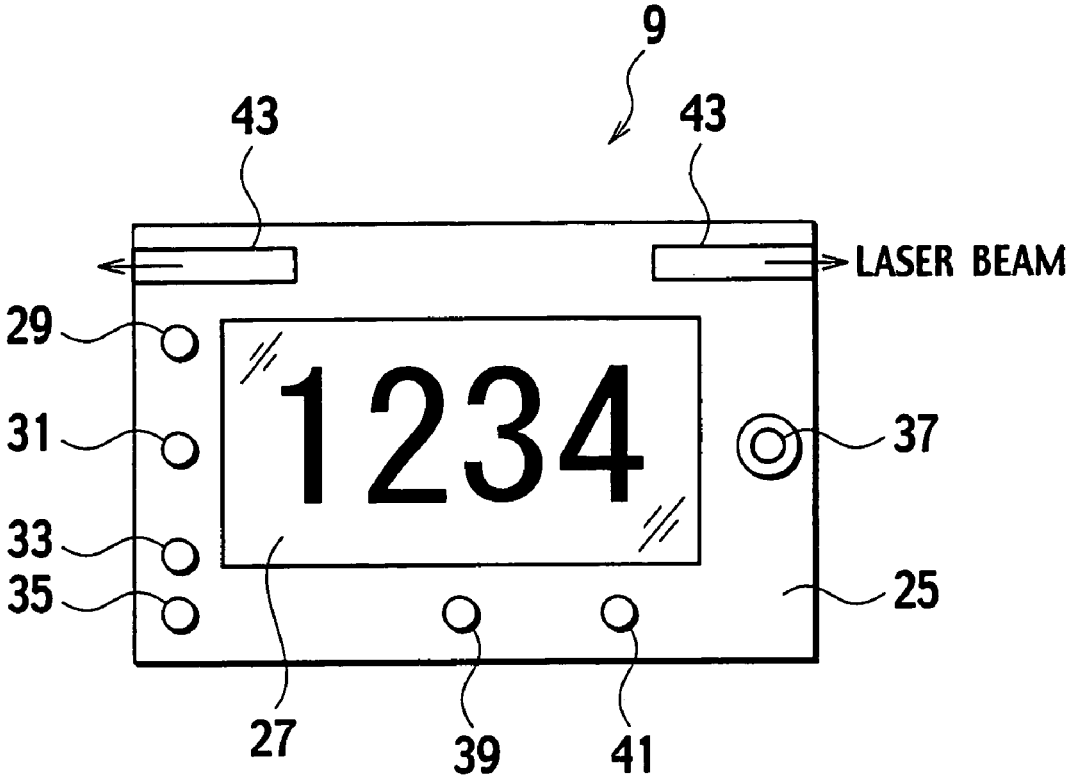
FIG. 5 is a plan view of a base unit of the presently filed embodiment.

As shown in FIG. 5, the base unit 9 includes a case body 25, and a display board 27 is located on a front and central area of the case body 25. Mounted on the case body 25 at, for instance, a left side area of the display board 27 are a temperature sensor 29, a gas sensor 31, a sound sensor 33 and a vibration sensor 35. Moreover, a speaker (sound generator) 37 is located on the case body 25 at a right side area of the display board 27, and a transmitter 39 and a receiver 41 are mounted on the case body 25 at a lower area of the display board 27. In addition, laser beam oscillators 43 are mounted on the case body 25 at left and right upper areas of the display board 27. As shown in FIGS. 1 and 4, display units 45 are located on the inside walls 17 at areas above the associated emergency exit plates 21, respectively, to be responsive to laser beams oscillated from the laser beam oscillators 43.

Figure 6:
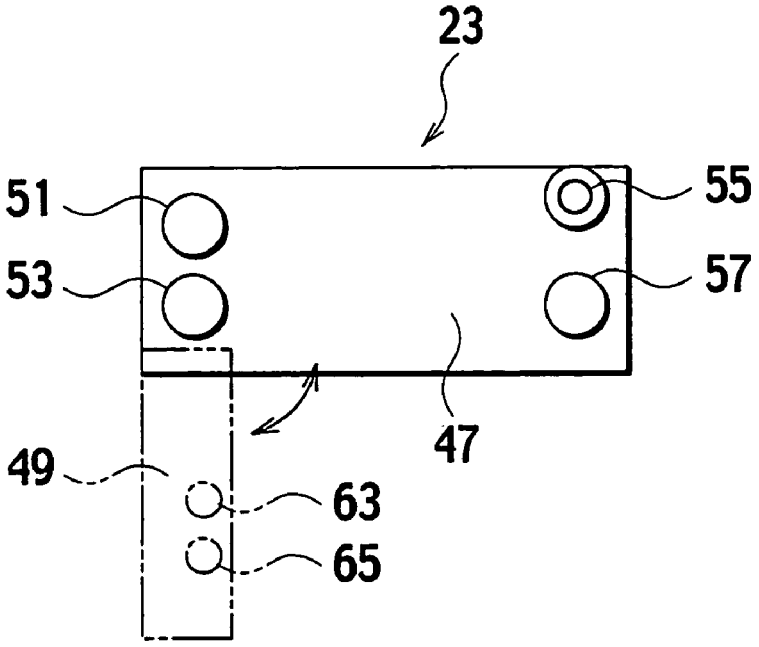
FIG. 6 is a front view of a mobile handset of the presently filed embodiment.
Figure 7:
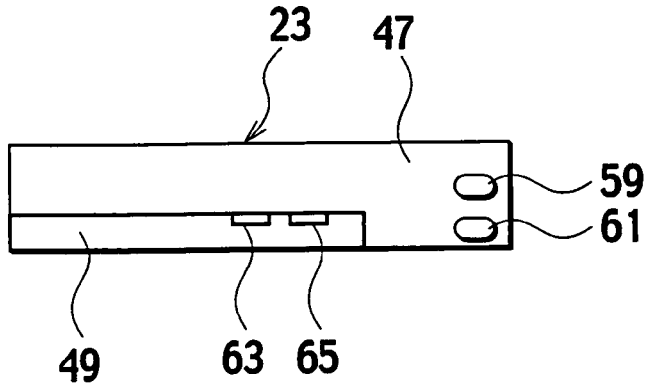
FIG. 7 is a front view of the mobile handset shown in FIG. 6.

As shown in FIGS. 6 and 7, each mobile handset 23 includes a case body 47, whose lower end is provided with a retractable frame 49. Mounted on the case body 47 in front and left side thereof are a temperature sensor 51 and gas sensor 53, and mounted on the case body 47 in front and right side thereof are a speaker 55 (sound generator means) and light source 57 (light generator means). Also, as shown in FIG. 7, provided on the case body 47 at, for instance, a front and right end thereof are a transmitter 59 and receiver 61. In addition, as shown in FIG. 6, located on the retractable frame 49 at a front and right side thereof are an infrared ray sensor button 63 and a rescue transmission button (an SOS transmission button) 65.

Figure 8:
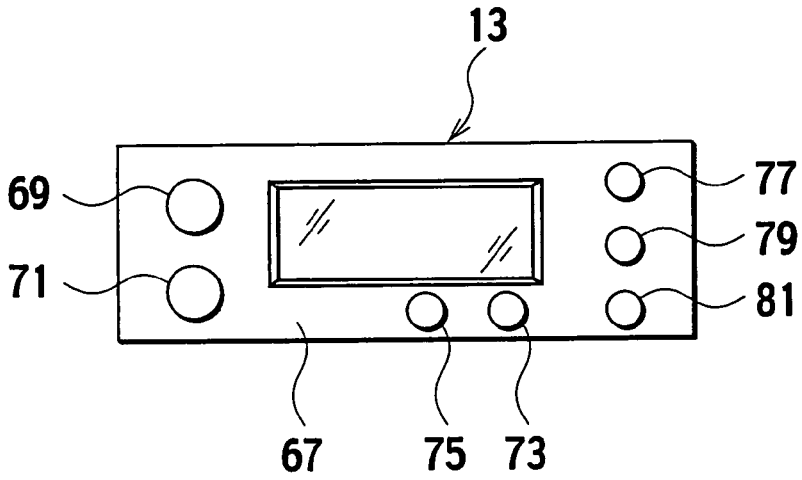
FIG. 8 is a plan view of an infrared ray sensor of the presently filed embodiment.

As shown in FIG. 8, each infrared ray sensor 13 includes a case body 67 and mounted on the case body 67 in front and left side area thereof are a temperature sensor 69 and gas sensor 71. Mounted on the case body 67 in front and lower area thereof are a transmitter 73 and receiver 75. Further, mounted on the case body 67 in front and right side area thereof are a speaker 77 (sound generator means), light source 79 (light generator means) and cancel button 81.

Figure 9:
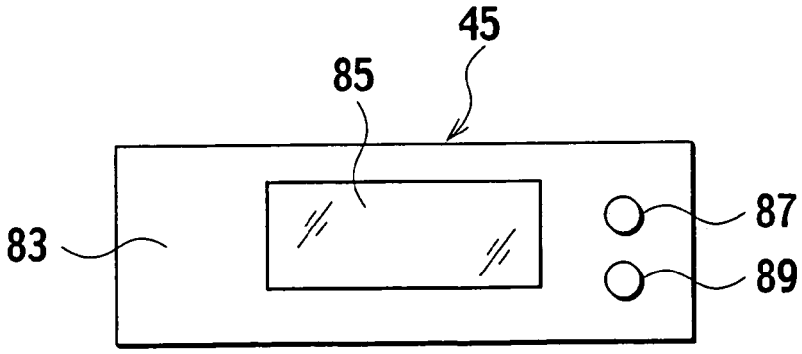
FIG. 9 is a plan view of a display unit of the presently filed embodiment.

As shown in FIG. 9, each display unit 45 includes a case body 83, whose central area is provided with a light emitting plate 85. For the purpose of permitting a light, indicative of a character of "EMERGENCY EXIT", to be emitted on the light emitting pate 85 for display, the case body 83 of the display unit 45 is provided with a receiver 87 adapted to receive a laser beam oscillated from the laser beam oscillator 43. Additionally, the display unit 45 is provided with, for instance, a speaker 89 (sound generator).

With such a structure set forth above, if the receiver 41 of the base unit 9 receives rescue signals (SOS signals) from the transmitter 59 of the mobile handset 23 and the transmitter 73 of the infrared sensor 13, the speaker 37 is activated to generate a large sound while providing a display of a room number on a room number display of the display board 27 by flashing (lights). Then, laser beams are irradiated toward the emergency exit plates 21, each of which is written as an "EMERGENCY EXIT", from the laser beam oscillator 43, and if the receivers 87, mounted on the respective display units 45, receives the laser beams, the light emitting plates 85 are activated to emit lights on the characters "EMERGENCY EXIT" for displays, respectively. At the same time, the speakers 89 are activated to generate sounds, which can be heard even from the emergency doorways 19, respectively. Also, the display board 27 is normally utilized as a clock and under an emergency condition, the room number can be displayed upon flashing of lights.

Further, in cases where any one of the temperature sensor 29, the gas sensor 31, the sound sensor 33 and the vibration sensor 35 provided in the base unit 9 senses a disaster, not only the base unit 9 executes the operations described above but also executes operations to allow the transmitter 39 to transmit the sensed result of the base unit 9 to the mobile handsets 23. Thus, the receivers 61 of the mobile handsets 23 receives the sensed result from the base unit 9 to be operative to generate sounds with the respective speakers 55 while generating lights with the respective light sources 57 to enable the inhabitants to be provided with information about the occurrence of the disaster. At the same time, the transmitter 39 of the base unit 9 transmits infrared ray signals to the infrared ray sensors 13, whose receivers 75 consequently receive the infrared ray signals to cause the associated speakers 77 to generate sounds, respectively, while causing the light sources 79 to emit lights to allow the inhabitants in the respective rooms 3 to be provided with notification of the occurrence of the disaster in a more reliable manner.

Under circumstances where any of the temperature sensors 51 and gas sensors 53 of the mobile handsets 23, owned by the inhabitants of the respective rooms 3, senses an abnormality, the relevant mobile 23 is automatically activated to provide the relevant inhabitant with information about the occurrence of a disaster while an output signal is transmitted from the transmitter 59 of the relevant mobile handset 23 to the base unit 9 whereby the receiver 41 of the base unit 9 receives the output signal. As a result, the speaker 37 generates a large sound and the relevant room number is displayed on the room number display of the display board 27 by flashing (of lights). Then, the laser beams are irradiated toward the left and right emergency exit plates 21, preliminarily written as "EMERGENCY EXIT", from the laser beam generator 43 and if the receivers 87 disposed on the display units 45 receive the laser beams, the light emitting plates 85 are enabled to provide displays of the characters "EMERGENCY EXIT". At the same time, the speakers 89 are activated to generate sounds, which can be heard from the emergency doorways 19. In the meantime, the retractable frame 49 of each mobile handset 23 is so configured that no signal is transmitted unless the retractable frame 49 is retracted from the case body 47 and the rescue transmission button 65 is depressed several times each for a predetermined time interval of, for instance, three seconds. That is, measures are taken to preclude erroneous operation caused under drunken conditions or involuntary manipulations.

Each infrared ray sensor 3 is automatically rendered operative upon detection of a criminal intruder who enters each room 3 and generates an alarm sound with the speaker 77 while rendering the light source 79 operative to cause flashing lights (strobe lights) whereby the inhabitant is provided with notification of an alarm state. In addition, the transmitter 73 transmits a signal to the base unit 9 and if the receiver 41 of the base unit 9 receives the signal, the speaker 37 generates a large sound while providing a display of the relevant room number on the room number display of the display board 27 by flashing. Then, the laser beams are irradiated toward the left and right emergency exit plates 21, preliminarily written as "EMERGENCY EXIT", from the laser beam oscillator 43 and if the receivers 87, disposed on the display units 45, receives the laser beams, the light emitting plates 85 are enabled to provide displays of the characters "EMERGENCY EXIT". At the same time, the speakers 89 are activated to generate sounds, which can be heard from the emergency doorways 19. Also, the display board 27 is normally utilized the clock and is enabled to display the room number display by flashing (of lights) under emergency conditions.

Further, if any of the temperature sensor 69 and the gas sensor 71 of the infrared sensor 13 in an uninhibited room 3 is rendered operative upon detection of an abnormality, then, the transmitter 73 automatically transmits a signal to the base unit 9 and upon receipt of this signal by the receiver 41 of the base unit 9, the speaker 37 generates a large sound while providing a display of a room number on the room number display of the display board 27 by flashing (of lights). Thereafter, the laser beams are irradiated toward the emergency exit plates 21, each of which is written as the "EMERGENCY EXIT", from the laser beam oscillator 43 and, upon receipt of the laser beams by the receivers 87 mounted on the display units 45, the characters "EMERGENCY EXIT" are displayed over the light emitting plates 85 for display. At the same time, the speakers 89 are activated to generate sounds, which can be heard even from the emergency doorways 19. Concurrently, the transmitter 37 of the infrared ray sensor 13 transmits signals to the mobile handsets 23, whereby the receivers 61 of the mobile handsets 23 receive the signals, respectively, upon which the speakers 55 generate sounds while causing the light sources 57 to flash the lights such that inhabitants who carry the mobile handsets 23 can be notified with information about the occurrence of an emergency condition in the uninhibited room 3. Also, the display board 27 is normally utilized as the clock and is enabled to display the room number display by flashing (of lights) under the emergency condition.

Furthermore, in cases where an inhabitant enters the room 3, the inhabitant deactivates the cancel button 81 disposed on the infrared ray sensor 13 of the room 3 and walks in the room.

Accordingly, with the hotel 1 installed in an area, attracting public attention, with the rescue system comprised of the base unit 9, which incorporates the temperature sensor 29, the gas sensor 31, the sound sensor 33 and the vibration sensor 35 and includes the transmitter 39, the receiver 41, the sound generator and the display board 27, the mobile handsets 23, carried by the persons at all times for emergency assists, which incorporates the temperature sensor 51 and the gas sensor 53 and includes the transmitter 59, the receiver 61, the sound generator 55 and the light source 57, and the infrared ray sensors 13 installed on the respective rooms of the hotel 1 and each including the temperature sensor 69 and the gas sensor 71 while incorporating the transmitter 73, it becomes possible to provide a complete rescue system wherein all the base unit 9, the mobile handsets 23 and the infrared ray sensors 13 mutually cooperate with each other under emergency conditions resulting from abnormal results in temperature, gas, sound and vibration to be operative to notify the inhabitants in the hotel 1 with information about the occurrence of the emergency condition to avoid any disaster that may occur.

Also, while the presently filed embodiment has been described in connection with the hotel as an exemplary case of the architectural structure on which the emergency system is installed, it doesn't matter if the architectural structure includes condominiums, hospitals, nursing and personal care facilities and aged care facilities or the like. Also, the emergency system of the presently filed embodiment can be utilized not only for insides of architectural structures but also for social crime-busting measures. For instance, placing the base unit 9 in a police station and a fire station while placing the infrared ray sensors 13 in respective homes whereas individuals carry the mobile handsets 23, respectively, at all times makes it possible to utilize the emergency system for the social crime-busting measures. Especially, such a system is optimum for elementary and junior high school students when they are commuting to or from school.

The entire content of Japanese Patent Application No. P2004-082997 with a filing data of Mar. 22, 2004 is herein incorporated by reference.

Although the present invention has been described above by reference to certain embodiments of the invention, the invention is not limited to the embodiments described above and modifications will occur to those skilled in the art, in light of the teachings. The scope of the invention is defined with reference to the following claims.

What is claimed is:

1. An emergency alarm system comprising:

a base unit, adapted to be installed in an architectural structure at an area attracting public attention, which includes a temperature sensor, a gas sensor, a sound sensor, a vibration sensor, a transmitter, a receiver, a sound generator and a display board;

a mobile handset carried by a person for self-defense and having a temperature sensor, a gas sensor, a transmitter, a receiver, a sound generator and a light source; and infrared ray sensors installed in respective rooms in the architectural structure and each having a temperature sensor, a gas sensor, a transmitter and a receiver; wherein when one of the sensors of the base unit, the mobile handset and the infrared ray sensors detects an abnormal signal under an emergency condition, the base unit, the mobile handset and the infrared ray sensors mutually communicate with each other through the transmitters and the receivers of the base unit, the mobile handset and the infrared ray sensors, respectively.

2. The emergency alarm system according to claim 1, wherein:

the base unit includes a laser beam oscillator that oscillates a laser beam.

3. The emergency alarm system according to claim 2, further comprising:

a display unit including a light emitting plate, incorporating a receiver that receives the laser beam oscillated from the laser beam oscillator to allow a character of "EMERGENCY EXIT" to be displayed in an emergency doorway of the architectural structure, and a sound generator.

4. The emergency alarm system according to claim 1, wherein:

the display board of the base unit normally provides a display of time of a clock and is operative to display a location in which the mobile handset or the infrared ray sensor generating the abnormal signal are present in the presence of the abnormal signal detected under the emergency condition.

5. The emergency alarm system according to claim 4, wherein:

the display board of the base unit is operative to display a location, in which the mobile handset or the infrared ray sensor generating the abnormal signal are present, by flashing a light.

6. The emergency alarm system according to claim 1, wherein:

the mobile handset includes a retractable frame on which an infrared ray sensor button and a rescue transmission button are mounted.

7. The emergency alarm system according to claim 6, wherein:

after a predetermined time interval has elapsed, the mobile handset is disenabled to output an abnormal signal caused by operating the rescue transmission button.

* * * * *